US006536231B2

(12) United States Patent
Gupte

(10) Patent No.: US 6,536,231 B2
(45) Date of Patent: Mar. 25, 2003

(54) TUBE AND SHELL HEAT EXCHANGER FOR MULTIPLE CIRCUIT REFRIGERANT SYSTEM

(75) Inventor: Neelkanth Shridhar Gupte, Liverpool, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/870,894

(22) Filed: May 31, 2001

(65) Prior Publication Data

US 2002/0179294 A1 Dec. 5, 2002

(51) Int. Cl.[7] ..... F25B 39/02; F25B 7/00; F28D 7/10

(52) U.S. Cl. ..... 62/524; 62/335; 165/140

(58) Field of Search ..... 62/524, 335, 267; 165/140

(56) References Cited

U.S. PATENT DOCUMENTS

| | | | | | |
|---|---|---|---|---|---|
| 358,514 | A | * | 3/1887 | Warden | 165/140 |
| 714,703 | A | * | 12/1902 | Ibert | 165/140 |
| 2,296,741 | A | * | 9/1942 | Sanders | 62/335 |
| 2,360,408 | A | * | 10/1944 | Dunn et al. | 165/140 |
| 2,764,876 | A | * | 10/1956 | Parcaro | 62/267 |
| 3,621,666 | A | * | 11/1971 | Mokadam | 62/79 |
| 4,104,890 | A | * | 8/1978 | Iwasaki | 62/324 |
| 4,157,649 | A | * | 6/1979 | Bussjager et al. | 62/81 |
| 4,201,065 | A | * | 5/1980 | Griffin | 62/510 |
| 4,256,783 | A | * | 3/1981 | Takada et al. | 422/197 |
| 5,048,601 | A | * | 9/1991 | Yamaguchi et al. | 165/140 |
| 5,097,897 | A | * | 3/1992 | Watanabe et al. | 165/140 |
| 5,755,280 | A | * | 5/1998 | da Costa et al. | 165/140 |

FOREIGN PATENT DOCUMENTS

| | | |
|---|---|---|
| JP | 9-14792 | 1/1990 |

* cited by examiner

*Primary Examiner*—William C. Doerrler
(74) *Attorney, Agent, or Firm*—Carlson Gaskey & Olds

(57) ABSTRACT

A multiple circuit shell and tube heat exchanger exchanges heat between a heat transfer fluid and refrigerant. The first portion of the heat transfer fluid flow enters a first refrigerant circuit and exchanges heat with refrigerant in the first circuit. The second portion of the heat transfer fluid flow then enters a second refrigerant circuit and exchanges heat with refrigerant in the second circuit. By employing a single heat transfer fluid pass, the average leaving temperature difference from each circuit can be reduced, reducing entropy generation and making the system more thermodynamically efficient.

15 Claims, 2 Drawing Sheets

TUBE AND SHELL HEAT EXCHANGER FOR MULTIPLE CIRCUIT REFRIGERANT SYSTEM

BACKGROUND OF THE INVENTION

The present invention relates generally to a shell and tube heat exchanger for a multiple circuit refrigeration system.

Heat exchangers, such as condensers and evaporators, are utilized in refrigeration cycles to exchange heat between a heat transfer fluid (e.g. water, brine or air) and a refrigerant. A single refrigerant circuit can be utilized in the refrigerant cycle. However, if the compressor needs service and is shut down, the refrigerant circuit cannot operate. Therefore, it is beneficial for two or more refrigerant circuits to be utilized. One refrigerant circuit may be switched off, allowing the other(s) to operate at full capacity or if service is required.

In a prior shell and tube heat exchanger, heat transfer fluid passes through the heat exchanger in two passes. For example, in a two pass heat exchanger including two refrigerant circuits, the first portion of the first heat transfer fluid pass and the second portion of the second heat transfer fluid pass exchange heat with one refrigerant circuit, and the second portion of the first heat transfer fluid pass and the first portion of the second heat transfer fluid pass exchange heat with the second refrigerant circuit. A partition plate perpendicular to the axis of the shell separates the two refrigerant circuits.

There are several drawbacks to the prior art shell and tube heat exchangers for a multiple circuit refrigerant system. For one, when all of the refrigerant circuits are operating at a full load condition, the entropy generation (the destruction or availability of energy) is high due to a relatively larger temperature differential between the heat transfer fluid and the refrigerant. Secondly, the difference between the saturated discharge temperature and the saturated suction temperature (temperature lift) is also high. The temperature lift is representative of the compression ratio and hence the compression power requirement.

Hence, there is a need in the art for an improved shell and tube heat exchanger for a multiple circuit refrigeration system.

SUMMARY OF THE INVENTION

The present invention relates to a shell and tube heat exchanger for a multiple circuit refrigeration system.

A shell and tube heat exchanger of the present invention includes a plurality of tubes positioned within a shell. Heat transfer fluid flows through the tubes and exchanges heat with refrigerant flowing around the tubes within the shell. For example, in a two pass circuit design, heat transfer fluid enters through an inlet and exchanges heat in the first portion (first pass) of the first refrigerant circuit. The heat transfer fluid enters a heat transfer fluid box and then enters the second portion (second pass) of the first refrigerant circuit. In a three-pass design, heat transfer fluid leaving the second pass enters a third portion (third pass) of the first refrigerant circuit. The relative position of various passes may be one above the other, side by side, or any combination thereof.

Heat transfer fluid crosses over to the second refrigerant circuit through a center heat transfer fluid box. Heat transfer fluid then enters the first portion (first pass) of the second refrigerant circuit and continues to exchange heat. The heat transfer fluid again enters a heat transfer fluid box and then enters the second portion (second pass) of the second refrigerant circuit. Because each refrigerant circuit is separate, each side of the heat exchanger can have an unequal shell diameter and unequal tube counts to optimize capacity and the coefficient of performance By employing a single heat transfer fluid circuit as described above, the average temperature difference between heat exchanging fluids can be reduced, reducing entropy generation and making the system more thermodynamically efficient. For the same amount of heat transfer area, the compressor power can be reduced significantly.

Accordingly, the present invention provides a shell and tube heat exchanger for a multiple circuit refrigeration system.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
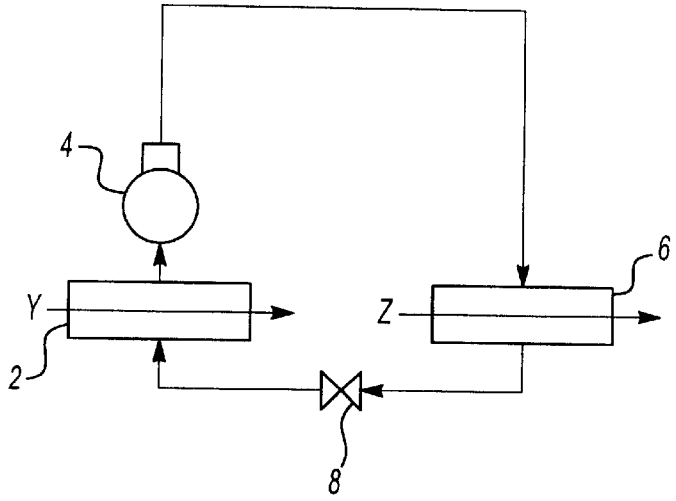
Fig-1 PRIOR ART
FIG. 1 illustrates a conventional prior art single refrigerant circuit refrigeration cycle.

FIG. 1 illustrates a conventional prior art single refrigerant circuit refrigeration cycle. Heat transfer fluid Y (e.g. water, brine or air) returning from application load is cooled in an evaporator 2, releasing heat to and evaporating the liquid refrigerant to form refrigerant vapor. The refrigerant vapor enters a compressor 4 and is compressed to a high pressure and a high temperature. The refrigerant then enters a condenser 6 and rejects heat to the heat transfer fluid Z. The refrigerant then enters the expansion valve 8, lowering both pressure and temperature and completing the cycle.

The saturation temperature of the refrigerant in the evaporator 2, the saturated suction temperature (SST), is less than the leaving temperature of the heat transfer fluid. The temperature of the refrigerant in the condenser 6, the saturated discharge temperature (SDT), is higher then the leaving temperature of the heat transfer fluid (or air if an air cooled condenser). The leaving temperature difference (LTD) is the difference between the leaving temperature of the heat transfer fluid and the refrigerant saturation temperature (either SST or SDT).

The difference between the saturated discharge temperature and the saturation suction temperature is defined as lift.

Compression work is needed to increase the saturation temperature of the refrigerant from the saturated suction temperature to the saturated discharge temperature. The lower the lift, the lower the specific compressor work (i.e. work required per unit mass flow rate) required, and the higher the coefficient of performance, COP. The coefficient of performance is the ratio of useful power to the power input.

The present invention includes a shell and tube heat exchanger employing a single heat transfer fluid circuit for the evaporator and liquid cooled condenser and at least two refrigerant circuits. In the preferred embodiment, two refrigerant circuits are employed.

Figure 2:
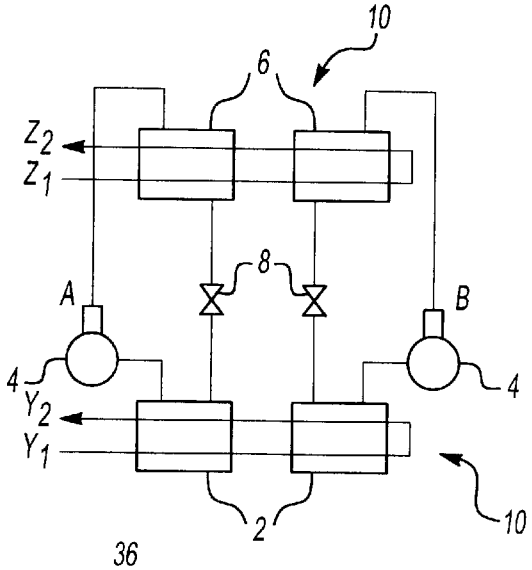
Fig-2 PRIOR ART
FIG. 2 illustrates a schematic view of a prior art dual refrigerant circuit refrigerant cycle using shell and tube heat exchangers.

FIG. 2 illustrates a prior art dual refrigeration circuit refrigeration cycle employing a two pass heat exchanger 10. The heat exchanger 10 can be either a condenser 6 or an evaporator 2. Although an evaporator 2 is described, a condenser 6 operates in similar fashion if the flows are reversed. The prior dual pass heat exchanger 10 employs two heat transfer fluid passes, $Y_1$ and $Y_2$. The dual pass heat exchanger 10 further includes refrigerant circuit A and refrigerant circuit B. During the first pass $Y_1$, heat transfer fluid passes through and exchanges heat with both refrigerant circuits A and B. During the second pass $Y_2$, the heat transfer fluid again passes through and exchanges heat with refrigerant circuit B and then again refrigerant circuit A.

In the prior dual pass heat exchanger 10 illustrated in FIG. 2, the refrigerant saturation temperature of the refrigeration circuit A must be less than the leaving temperature of the heat transfer pass $Y_2$ exiting the refrigeration circuit A to be able to lower the leaving temperature of the heat transfer fluid. However, this causes a relatively large temperature difference between temperature of the heat transfer fluid leaving refrigeration circuit A in heat transfer fluid pass $Y_1$ and the saturation temperature of the refrigerant in circuit A This is disadvantageous as the temperature difference between heat exchanging fluids becomes larger, thermodynamic losses from the heat transfer process become larger.

Figure 3:
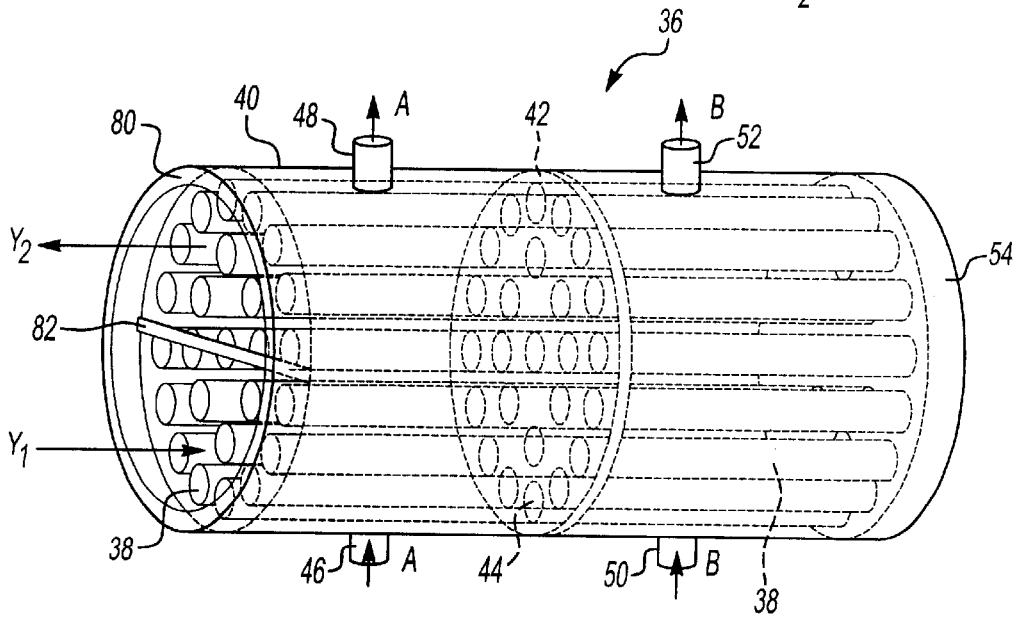
Fig-3 PRIOR ART
FIG. 3 illustrates the prior art dual refrigerant circuit shell and tube heat exchanger utilized as an evaporator or a liquid cooled condenser.

FIG. 3 illustrate a prior art shell and tube heat exchanger 36 used in a dual circuit refrigerant cycle using two heat transfer fluid passes. Heat transfer fluid flows through a plurality of copper tubes 38 and refrigerant surrounds the tubes 38 positioned within a shell 40, exchanging heat. A center partition plate 42 perpendicular to the axis of the shell 40 separates refrigerant circuit A and refrigerant circuit B. The partition plate 42 includes a plurality of apertures 44 to receive the plurality of tubes 38. A pass partition plate 82 perpendicular to the center partition plate 42 separates the heat transfer fluid passes $Y_1$ and $Y_2$.

Heat transfer fluid from a first refrigerant box 80 enters pass $Y_1$. Inlet heat transfer fluid enters the refrigerant circuit A through the plurality of tubes 38 and exchanges heat with refrigerant circuit A. Refrigerant of refrigerant circuit A enters the shell 40 through inlet 46 and exits the shell 40 through outlet 48. Although the inlet 46 is illustrated at the bottom surface, the inlet 46 can be positioned at other locations in other type evaporators. Heat transfer fluid then enters and exchanges heat with the second refrigerant circuit B. Refrigerant of refrigerant circuit B enters the shell 40 through inlet 50 and exits the shell 40 through outlet 52. The heat transfer fluid from $Y_1$ then enters a heat transfer fluid box 54. The heat transfer fluid then enters pass $Y_2$ through tubes 48 and passes again through refrigerant circuits A and B. In the prior art design, the tubes 38 are of substantially the same diameter. Additionally both refrigerant circuits A and B include an equal number of tubes. The only flexibility in design is in the length of the tubes.

Figure 4:
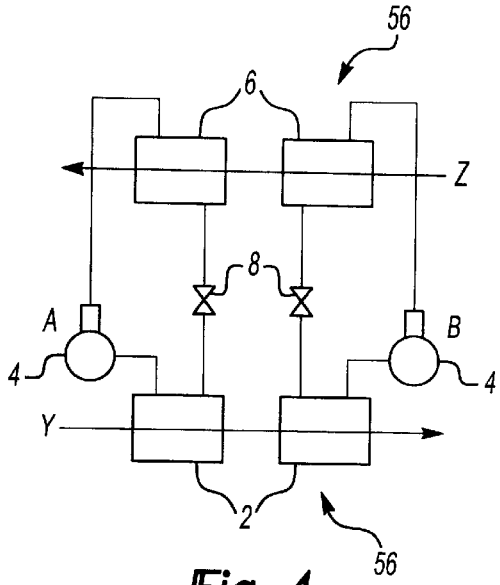
FIG. 4 illustrates a schematic view of a dual refrigerant circuit refrigerant cycle utilizing shell and tube heat exchangers of the present invention.

FIG. 4 illustrates a schematic diagram of the single heat transfer fluid circuit shell and tube heat exchanger 56 of the present invention. The first portion of heat transfer fluid circuit Y exchanges heat with first refrigerant circuit A, and the second portion of the heat transfer fluid circuit Y exchanges heat with second refrigerant circuit B.

Figure 5:
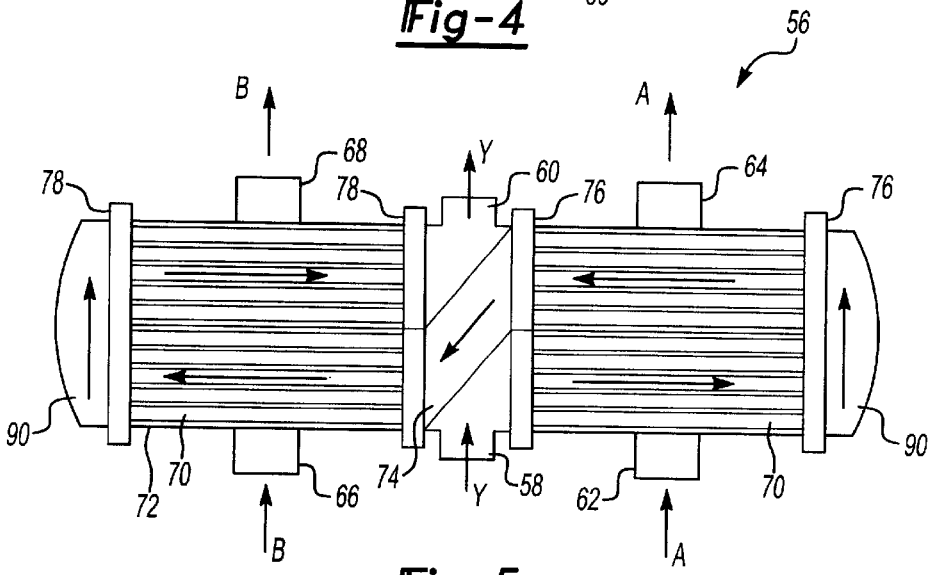
FIG. 5 illustrates the dual refrigerant circuit shell and tube heat exchanger of the present invention utilized as an evaporator or liquid cooled condenser.

FIG. 5 illustrates the dual circuit shell and tube heat exchanger 56 of the present invention utilizing two refrigerant circuits A and B, each circuit having two water passes. The heat exchanger 56 includes a plurality of tubes 70 contained within a shell portion 72. Heat transfer fluid enters the heat exchanger 56 through an inlet nozzle 58 and exits through an outlet nozzle 60, both located substantially in the center of the tube and shell heat exchanger 56 in a design using an even number of water passes. If there are an odd number of water passes, the inlet nozzle 58 and the outlet nozzle 60 are located at opposite ends of the tube and shell heat exchanger 56.

The heat exchanger 56 further includes an inlet 62 and outlet 64 for refrigerant circuit A and an inlet 66 and outlet 68 for refrigerant circuit B. Heat transfer fluid enters the heat transfer fluid inlet nozzle 58 and passes through and exchanges heat with the first refrigerant circuit A. Circuit partitions 76 prevent the refrigerant from escaping the shell portion 72. At the ends of first pass, the heat transfer fluid enters a heat transfer fluid box 90. After completing exchanging heat with refrigerant circuit A, the heat transfer fluid exits the tubes 70 and enters the center heat transfer fluid box 74. The heat transfer fluid crosses over to the second refrigerant circuit B and exchanges heat with the refrigerant. Circuit partitions 78 prevent the refrigerant from escaping. At the ends of this pass, the heat transfer fluid enters another heat transfer fluid box 90. The heat transfer fluid exits through the heat transfer fluid outlet 60. If the heat exchanger is a condenser, the flows are reversed.

This can also be extended to a heat exchanger utilizing more than two refrigerant circuits and using one or more heat transfer fluid passes in each refrigerant circuit or any combination thereof. In a three pass design, heat transfer fluid exiting the second pass enters a third portion (third pass) of the first refrigerant cycle. The relative position of the various passes may be one above the other, side by side, or any combination thereof.

Because refrigerant circuits A and B are separate and the heat transfer fluid inlet 58 and heat transfer fluid outlet 60 are located substantially between the circuits A and B, the refrigerant circuits can have unequal shell diameter and unequal tube counts. This allows for more flexibility in design and an ability to achieve target capacity and coefficient of performance. Additionally, it is preferred that the heat transfer area be proportional to the compressor capacity.

Figure 6:
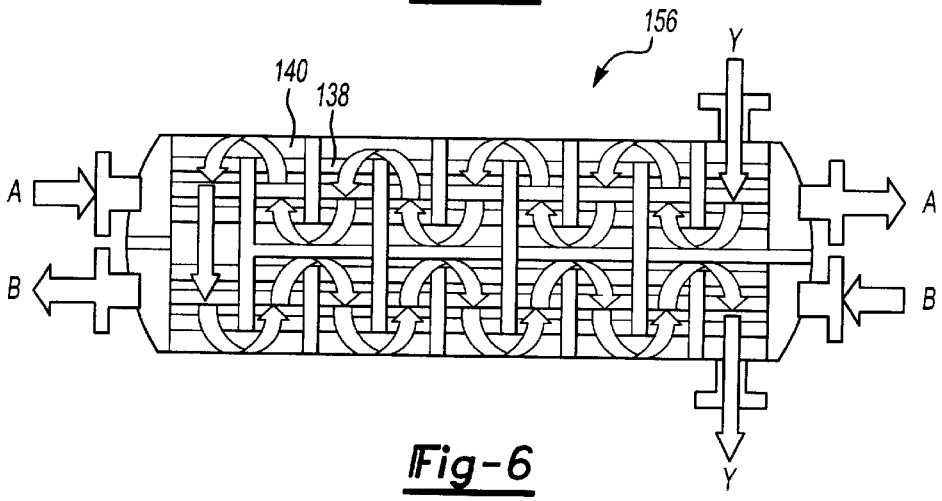
FIG. 6 illustrates another embodiment of the dual refrigerant circuit shell and tube heat exchanger of the present invention.

The heat exchanger 156 of the present invention can also be utilized in a DX evaporator or compressor, as illustrated in FIG. 6. In this embodiment, the heat transfer fluid circuit Y flows in the shell 140 and surrounds the tubes 138 in which the refrigerant circuits A and B flow. This type of heat exchanger 156 is typically utilized with reciprocating, screw or scroll compressors.

The refrigerant circuits can be organized in several manners. In one embodiment, refrigerant circuit A exchanges heat with the entering heat exchange fluid of both an evaporator and a condenser. In another embodiment, refrigerant circuit A exchanges heat with the entering heat exchange fluid of the evaporator and the leaving heat exchanger fluid of the condenser. It is also possible to combine the multiple circuit heat exchanger of the present invention with a prior art heat exchanger. In all of these embodiments, refrigerant circuit B would exchange heat with the remaining heat exchange fluid portion.

There are several advantages to utilizing the multiple refrigerant circuit heat exchanger of the present invention. By employing a single heat transfer fluid circuit, the average leaving temperature difference of each refrigerant circuit is reduced, reducing entropy generation and resulting in fewer thermodynamic losses. Additionally, there is a reduction in compressor lift (difference between the saturated discharge temperature and the saturated suction temperature for the compressor). This results in a reduction of the consumption of power, which improves the coefficient of performance of the refrigerant cycle.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A shell and tube heat exchanger comprising:

a plurality of tubes in a shell;

a plurality of refrigerant circuits each containing a refrigerant; and a stream of heat transfer fluid flowing through said plurality of said tubes that exchanges heat with said refrigerant in each of said plurality of refrigerant circuits, said stream of heat transfer fluid traveling between said plurality of refrigerant circuits through a heat transfer fluid connector, said heat transfer fluid exiting and reentering said plurality of tubes to travel through said heat transfer fluid connector.

2. The shell and tube heat exchanger as recited in claim 1 wherein there is a first refrigerant circuit and a second refrigerant circuit.

3. The shell and tube heat exchanger as recited in claim 2 wherein said stream of heat transfer fluid exchanges heat with a first refrigerant in said first refrigerant circuit, flows through said connector, and exchanges heat with a second refrigerant in said second refrigerant circuit, said shell containing said first refrigerant and said second refrigerant.

4. A shell and tube heat exchanger comprising:

a first refrigerant circuit and a second refrigerant circuit each containing a refrigerant in a shell; and a stream of heat transfer fluid flowing through a plurality of tubes positioned in said shell that exchanges heat with said refrigerant in each of said refrigerant circuits, said stream of heat transfer fluid traveling between said refrigerant circuits through a heat transfer fluid connector, and said stream of heat transfer fluid flows through said plurality of tubes and exchanges heat with said refrigerant in said first refrigerant circuit, flows through said heat transfer fluid connector, and then reenters said plurality of tubes and exchanges heat with said refrigerant in said second refrigerant circuit.

5. The shell and tube heat exchanger as recited in claim 4 wherein a number of said plurality of tubes in said first refrigerant circuit is substantially equal to a number of said plurality of tubes in said second refrigerant circuit.

6. The shell and tube heat exchanger as recited in claim 4 wherein a number of said plurality of tubes in said first refrigerant circuit is substantially unequal to a number of said plurality of tubes in said second refrigerant circuit.

7. The shell and tube heat exchanger as recited in claim 4 wherein a diameter of said shell of said first refrigerant circuit is substantially unequal to a diameter of said shell of said second refrigerant circuit.

8. The shell and tube heat exchanger as recited in claim 1 wherein said heat transfer fluid is water.

9. The shell and tube heat exchanger as recited in claim 1 wherein said heat transfer fluid is brine.

10. The shell and tube heat exchanger as recited in claim 1 wherein said heat exchanger is a condenser.

11. The shell and tube heat exchanger as recited in claim 1 wherein said heat exchanger is an evaporator.

12. A refrigeration system comprising:

a compression device to compress a refrigerant to a high pressure;

a first shell and tube heat exchanger including a plurality of tubes in a shell, said plurality of tubes containing a stream of heat transfer fluid which exchanges heat with a first refrigerant in a first refrigerant circuit, passes through said a connector, and exchanges heat with a second refrigerant in a second refrigerant circuit, said shell containing said first refrigerant and said second refrigerant which passes around said plurality of tubes, said heat transfer fluid exiting and reentering said plurality of tubes to travel through said heat transfer fluid connector;

an expansion device for reducing said refrigerant to a low pressure; and a second shell and tube heat exchanger.

13. A refrigeration system comprising:

a first and a second compression device to compress a first and a second refrigerant, respectively, to a high pressure;

a first shell and tube heat exchanger including a plurality of tubes in a shell, said plurality of tubes containing a stream of heat transfer fluid which exchanges heat with first a first refrigerant in a first refrigerant circuit, passes through a connector, and exchanges heat with said second refrigerant in an oppositely positioned second refrigerant circuit, said shell containing said first refrigerant and said second refrigerant which passes around said plurality of tubes;

a first and a second expansion device to reduce said first and said second refrigerant, respectively, to a low pressure; and a second shell and tube heat exchanger.

14. The refrigeration system as recited in claim 13 wherein said second shell and tube heat exchanger further includes a plurality of tubes passing through a shell and containing a stream of heat transfer fluid passing once through a first refrigerant circuit, through a connector, and once through an oppositely positioned second refrigerant circuit, said stream of heat transfer fluid exchanging heat with a first refrigerant in said first refrigerant circuit and a second refrigerant in a second refrigerant circuit and traveling between said first and second refrigerant circuits through said connector, said shell containing said first and second refrigerant which passes around said plurality of tubes.

15. A refrigeration system comprising:

a compression device to compress a refrigerant to a high pressure;

a first shell and tube heat exchanger including a plurality of tubes in a shell containing a stream of heat transfer fluid, said stream of heat transfer fluid exchanging heat with a first refrigerant in a first refrigerant circuit, passes through a connector, and exchanges heat with a second refrigerant in an oppositely positioned second refrigerant circuit, said shell containing said first refrigerant and said second refrigerant which passes around said plurality of tubes, said heat transfer fluid exiting and reentering said plurality of tubes to travel through said heat transfer fluid connector;

an expansion device for reducing said refrigerant to a low pressure; and a second shell and tube heat exchanger including a plurality of tubes in a shell and containing an additional stream of heat transfer fluid, said additional stream of heat transfer fluid exchanging heat with said first refrigerant circuit in said first refrigerant circuit, passes through a connector, and exchanges heat with said second refrigerant in said oppositely positioned second refrigerant circuit, said shell containing said first refrigerant and said second refrigerant which passes around said plurality of tubes.

* * * * *

UNITED STATES PATENT AND TRADEMARK OFFICE

CERTIFICATE OF CORRECTION

PATENT NO. : 6,536,231 B2
DATED : March 25, 2003
INVENTOR(S) : Neelkanth Shridhar Gupte It is certified that error appears in the above-identified patent and that said Letters Patent is hereby corrected as shown below:

Column 6,
Line 46, "tubes;" should be -- tubes, said heat transfer fluid exciting and reentering said plurality of tubes to travel through said heat transfer fluid connector; --

Signed and Sealed this

Twelfth Day of August, 2003

JAMES E. ROGAN
*Director of the United States Patent and Trademark Office*